US005727318A

United States Patent [19]

Reiswig

[11] Patent Number: 5,727,318

[45] Date of Patent: Mar. 17, 1998

[54] CLIPPERS FOR FINGERNAILS

[76] Inventor: Gary J. Reiswig, 17190 S.W. 131st, Tigard, Oreg. 97224

[21] Appl. No.: 780,048

[22] Filed: Dec. 23, 1996

[51] Int. Cl.[6] ..... A45D 29/02

[52] U.S. Cl. ..... 30/29; 30/242

[58] Field of Search ..... 30/26, 27, 29, 30/208, 241, 242, 243, 335; 132/73, 75.4, 75.5

[56] References Cited

U.S. PATENT DOCUMENTS

| | | | |
|---|---|---|---|
| 54,966 | 5/1866 | Schwartz | 132/75.4 |
| 205,088 | 6/1878 | Hollman . | |
| 523,708 | 7/1894 | La Casse . | |
| 695,342 | 3/1902 | Reed . | |
| 853,832 | 5/1907 | Ryan . | |
| 954,325 | 4/1910 | Moore | 30/26 |
| 1,347,651 | 7/1920 | Nauth . | |
| 1,927,234 | 9/1933 | Hawkins . | |
| 2,540,782 | 2/1951 | Hansen . | |
| 2,616,436 | 11/1952 | Langley . | |
| 2,620,560 | 12/1952 | Bahr | 30/26 |
| 2,955,354 | 10/1960 | Laing . | |
| 3,600,803 | 8/1971 | Nachsi | 30/27 |
| 3,825,961 | 7/1974 | Klein . | |
| 3,838,507 | 10/1974 | Clark . | |
| 4,111,207 | 9/1978 | Seiler, Jr. . | |
| 4,228,585 | 10/1980 | Nelson | 30/29 |
| 4,644,644 | 2/1987 | Elsholz . | |
| 4,819,673 | 4/1989 | McMullen, Jr. . | |
| 4,856,190 | 8/1989 | Reiswig . | |
| 5,065,513 | 11/1991 | Reiswig . | |
| 5,106,364 | 4/1992 | Hayafuji et al. . | |
| 5,123,430 | 6/1992 | Davidovitz | 30/29 |
| 5,357,676 | 10/1994 | Bannett . | |
| 5,533,262 | 7/1996 | Clark | 30/29 |
| 5,557,849 | 9/1996 | Lee et al. . | |

FOREIGN PATENT DOCUMENTS

| | | | |
|---|---|---|---|
| 405554 | 1/1910 | France | 30/29 |
| 582902 | 8/1933 | Germany . | |

*Primary Examiner*—Hwei-Siu Payer
*Attorney, Agent, or Firm*—Kolisch Hartwell Dickinson McCormack & Heuser

[57] ABSTRACT

The clipper of the present invention includes a clipper handle with a first component and a second component which are moveable with respect to each other. A nail holder extends from the clipper handle, the nail holder having a curved cross section. A slot for receiving the fingernail to be clipped is defined in the nail holder. A blade is slidably mounted with respect to the nail holder, and has a cross section which corresponds to the curved cross section of the nail holder. The blade terminates in a blade edge. The nail holder and the blade are each mounted to one of the first and second components. Therefore, when relative movement is effected between the handle components, a sliding action takes place between the nail holder and the blade to cut a nail which has been inserted into the slot in the nail holder. The curved cross section of the nail holder and the blade ensures that the nail will be cut in an ideally rounded configuration.

17 Claims, 4 Drawing Sheets

10
12
14
16
18
20
21
22
24
26
28
30
32
34
36
38
40
42
44
46
48
50
52
54
2
3A

CLIPPERS FOR FINGERNAILS

BACKGROUND OF THE INVENTION

The present invention relates generally to fingernail clippers and particularly to clippers used for both artificial and natural fingernails. Artificial nails can be attached to natural fingernails to provide the appearance of long, natural nails. Artificial nails are typically composed of elongate plastic material having a crescent-shaped cross section similar to a natural nail but thicker and much stronger. As a result, artificial nails are less likely to split or break. However, many individuals do not like the inconvenience and expense of applying and maintaining artificial nails, and therefore prefer to wear their natural fingernails.

To mount artificial nails in place, they are first attached to the natural nail and then clipped to a desired length with a series of lateral cuts across the nail to form a rough outline of the desired curvature. The roughened edge is then filed into a smooth, continuous curvature, and is then buffed. In the filing and buffing steps, plastic dust is introduced into the work area. This dust can adhere to any previously applied but wet fingernail polish in the area, is potentially harmful to personnel when ingested over a long period of time, and is generally troublesome to have to deal with in the work area.

To overcome some of the problems inherent in the above-described process, I developed a single-cut clipper for artificial nails, and was granted a U.S. Pat. No. 4,856,190. That patent describes a nail clipper having a nail holder with a crescent-shaped aperture to receive an artificial fingernail. It has a straight-edged blade slideably mounted in face-to-face relation to the nail holder. As the blade of the clipper is actuated, its edge is driven across the aperture to sever the artificial nail and form with one stroke a cut of desired continuous curvature controlled by suitable orientation of the clipper as the nail is clipped.

I later developed an improved clipper for which I received U.S. Pat. No. 5,065,513. This patent discloses a stationary nail holder with an aperture for receiving the fingernail, a cutting blade slideably disposed against and above the nail holder, and a blade mounting member which extends past the cutting blade and is secured in the nail holder. An operating handle includes a pivotable member which causes the cutting blade to slide forward to effect cutting of the nail. Pivoting of the pivotable member tends to exert an upward force on the rear end of the cutting blade to ensure that the forward edge of the cutting blade is in close contact with the nail holder, thereby ensuring a clean cut.

The operator of this nail cutter can tilt the fingernail in one direction or the other and thereby vary the rounding of the cut. However, the rounding which is thereby provided is sometimes not sufficient to satisfy the customer.

At least two other prior attempts have been made at coming up with a fingernail clipper which can provide a uniformly rounded cut. One such effort is disclosed in U.S. Pat. No. 523,708 to La Casse. While this device provides a simple, compact unit, it is not useful with longer fingernails where a substantial portion of the nail needs to be removed. This is commonly what needs to be done with respect to artificial fingernails. Also, in this unit the blade abuts against a portion of the cutter as the cut is being made, and even La Casse appreciates that over time this will result in dulling of the cutting edge. Also, as the blade is effecting its cut, the blade is within a slot, unsupported from either side. This can present a problem with rigid, thick artificial nails, especially after the blade becomes worn and somewhat dull. U.S. Pat. No. 2,540,782 to Hansen attempts to provide a cutter which will result in a curved nail, but this unit similarly is not usable where a substantial portion of the nail needs to be removed. The cutting blade in Hansen would also be difficult to replace as it becomes dull over time, which is a common concern to the professional as well as the personal user. Moreover, in both the La Casse and Hansen units, the end of the fingernail is concealed during the cutting operation, thereby rendering the clippers more difficult to use, not only for the personal user but also for the skilled manicurist who is used to cutting with great precision.

Some of these same problems are present with natural fingernails. For example, it is desirable to have uniform curvature to all of the person's fingernails. It is also necessary that the blade of any nail clipper last in a sharp condition just as long as possible. Finally, it is highly desirable that the end of the nail be visible through the clipper during the clipping process in order to ensure that precisely the desired cut is achieved.

Accordingly, it is an object of the present invention to provide a fingernail clipper which overcomes the drawbacks and limitations of the prior proposals. More specifically, the invention has as its objects the following:

(1) to develop a fingernail clipper which can remove a substantial portion of either an artificial and natural fingernail in a single cut, thereby saving time and limiting clippings and grinding dust;

(2) the provision of a clipper which can provide a curved cut with a minimum of manipulation and which can be consistent from fingernail to fingernail;

(3) to provide a fingernail clipper which is simple to manufacture and therefore less expensive than some clippers presently available; and (4) the development of a fingemail clipper which provides a guide for the blade during clipping, and which permits easy removal and replacement of the blade.

SUMMARY OF THE INVENTION

The clipper of the present invention includes a clipper handle with a first component and a second component which are moveable with respect to each other. A nail holder extends from the clipper handle, the nail holder having a curved cross section. A slot for receiving the fingernail to be clipped is defined in the nail holder. A blade is slidably mounted with respect to the nail holder, and has a cross section which corresponds to the curved cross section of the nail holder. The blade terminates in a blade edge. The nail holder and the blade are each mounted to one of the first and second components. Therefore, when relative movement is effected between the handle components, a sliding action takes place between the nail holder and the blade to cut a nail which has been inserted into the slot in the nail holder. The curved cross section of the nail holder and the blade ensures that the nail will be cut in an ideally rounded configuration.

Another aspect of the invention is a fingernail clipper with a nail holder having a curved cross section and a slot defined therein for receiving the nail to be clipped. A blade is disposed under the nail holder and has a similar cross section, so that the nail holder guides the blade through its entire stroke. The nail is clipped by inserting the nail into the aperture from the underside thereof, and then effecting relative movement between the nail holder and the blade.

Yet another aspect of the invention is a fingernail clipper for trimming a fingernail to an arcuate shape that curves downwardly toward each side of the fingernail. The clipper includes a nail holder with an aperture therein, the nail holder and the aperture being curved downwardly to produce the arcuate shape. A movable blade having a cutting edge disposed slidably against the nailholder is also included, the cutting edge being movable across and past the aperture when relative movement is effected between the nail holder and the blade. Like the nail holder, the blade is curved downwardly to produce the arcuate shape. The nail holder further serves to guide the blade across and past the aperture. The clipper also includes a handle having first and second components which are movable with respect to each other. The first component is mounted to the nail holder, and the second component is mounted to the blade so that when relative movement is effected between the first and second component, the blade slides with respect to the nail holder. This moves the blade edge across and past the aperture while being guided by the nail holder to clip the fingernail disposed within the aperture.

These and other objects and advantages of the present invention will become more fully apparent as the description which follows is read in conjunction with the drawings.

BRIEF DESCRIPTION OF THE DRAWINGS

FIGS. 8A and 8B are similar to FIG. 2 in that they show front elevation views of the embodiment of FIG. 1, except that they show a fingernail being cut, with FIG. 8A showing the nail in a cutting position with the top of the nail facing the clipper, while FIG. 8B shows the nail being cut with the underside of the nail facing the clipper.

DETAILED DESCRIPTION OF THE PREFERRED EMBODIMENT

Figures 1, 2, 4:
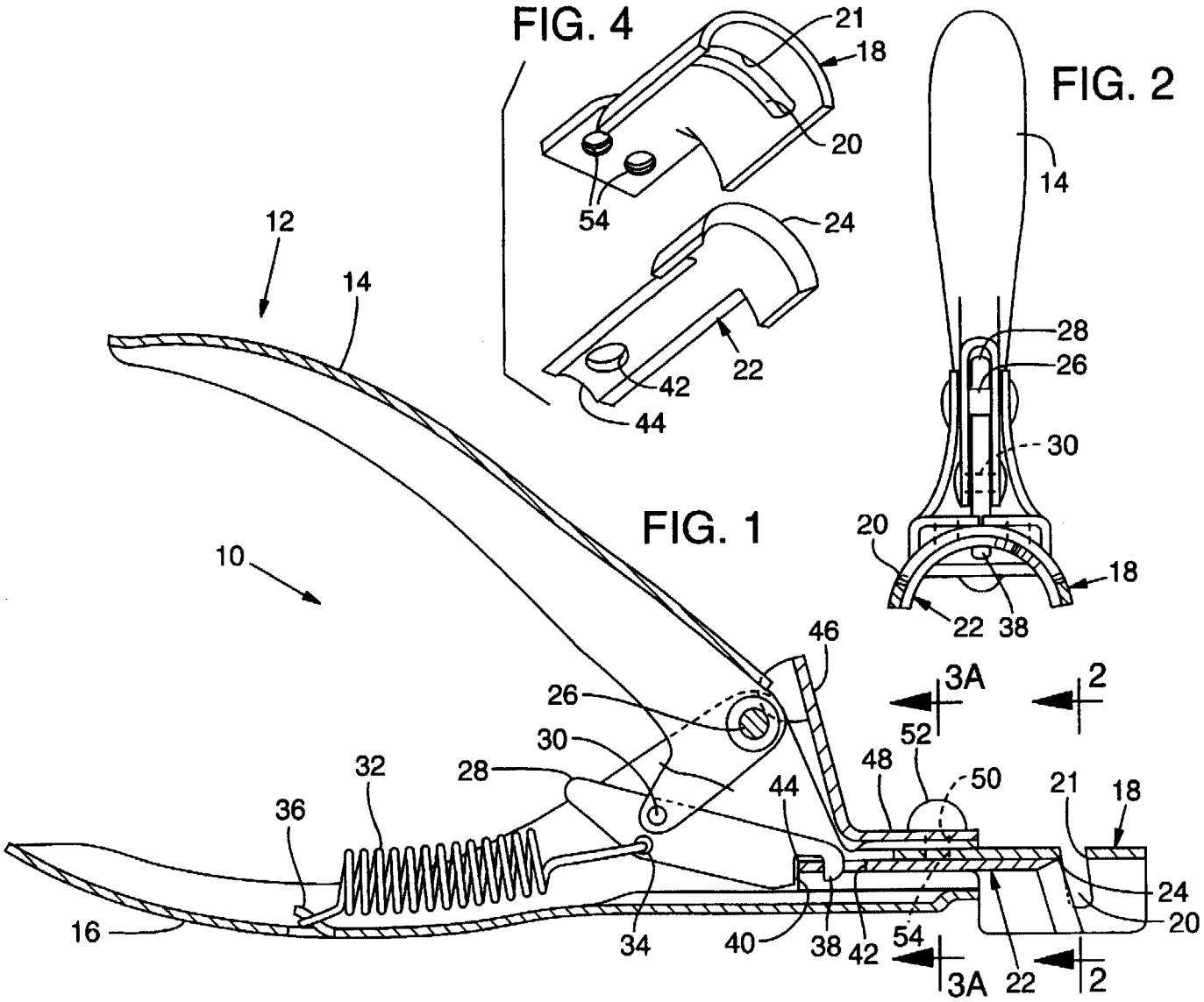
FIG. 1 is a side elevation sectional view of a preferred embodiment of the present invention.
FIG. 2 is a front elevation sectional view taken along line 2—2 of FIG. 1.
FIG. 4 is an isometric view of the nail holder and the blade of the embodiment of FIG. 1, showing them blown-up and disassociated from the nail holder.

The objects of the invention are best accomplished when the invention takes the form of the embodiment depicted in FIGS. 1–9. The fingernail clipper of this preferred embodiment is shown generally at 10 in FIGS. 1 and 9. The clipper 10 includes a handle 12 with a first component 14 and a second component 16. The first component 14 is alternatively referred to herein as a pivotable component or member, while the second component 16 is sometimes referred to herein as a stationary component or member. A nail holder 18 is shown in the FIGS. 1 and 9 but is perhaps best illustrated in FIG. 4. The nail holder includes a slot 20 which is designed to receive and hold the fingernail during a cutting or trimming operation. The slot 20 is shown to be slightly curved as shown in FIGS. 5A and B and 7A, and is somewhat inclined as shown in FIG. 7B. The curvature conforms to the normal curvature of a fingernail, whether artificial or natural, while the inclined cut of the slot appears to provide the best cutting action as the blade slides across and past the slot to effect cutting of the nail. The nail holder includes a cutting edge 21 which defines the forward edge of the slot, as shown in FIGS. 5A and B and 7A and B.

A blade 22 is also shown in FIGS. 5A–B and 6A–C. The blade terminates in a forward edge referred to herein as a blade edge 24, which is shown in those same Figures, extending at a slight angle with regard to its length and its direction of movement. In the preferred embodiment the angle is approximately ten degrees.

The nail holder 18 and blade 22 both have a curved cross section, with the blade nesting into the underside of the nail holder and being slidably mounted to it. The nail holder 18 thus further serves as a guide for the blade, and in the depicted embodiment serves as a guide for the entire stroke of the blade. This is desirable because otherwise the blade might be unguided or unsupported as it passes over the slot where the nail is actually being cut. Such support is important, especially when the clipper is used to cut artificial nails, which are typically harder and thicker than natural nails.

Figure 8A:
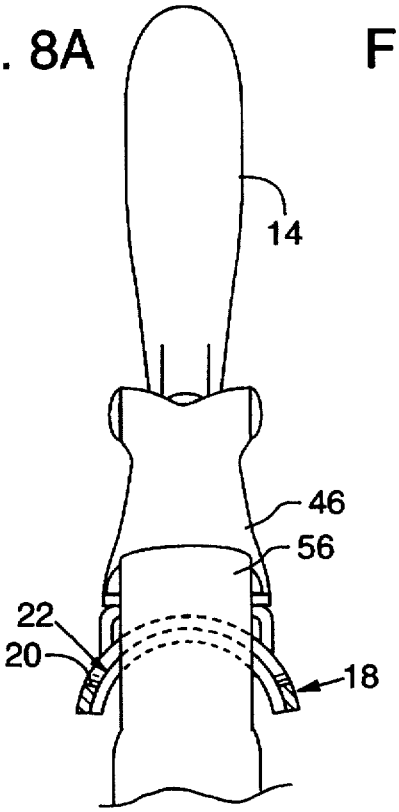

As shown best in the views of FIGS. 8A and B, the curvature of the nail holder 18 and blade 22 is intended to correspond to the approximate desired curvature of the final nail cut. Another way to describe the configuration of the nail holder 18 and blade 22 is that they have an arcuate shape which curves downwardly toward each side of the fingernail.

Figure 6A:
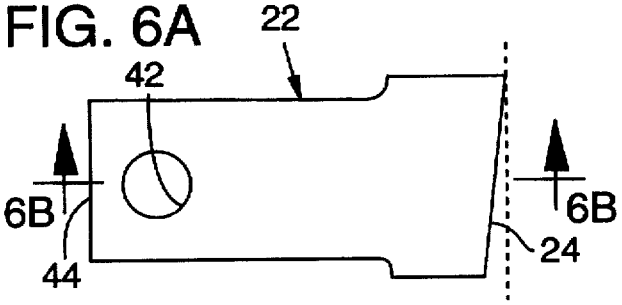
FIG. 6A is a top plan view of the blade of FIG. 1, showing the angulation of the cutting edge thereof.
Figure 6B:
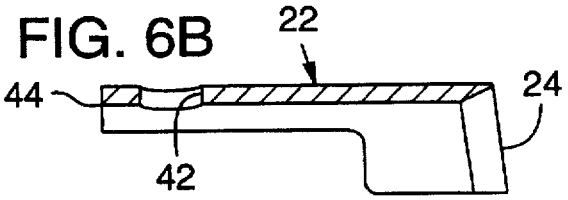
FIG. 6B is a side elevation sectional view taken along line 6B—6B of FIG. 6A.
Figure 6C:
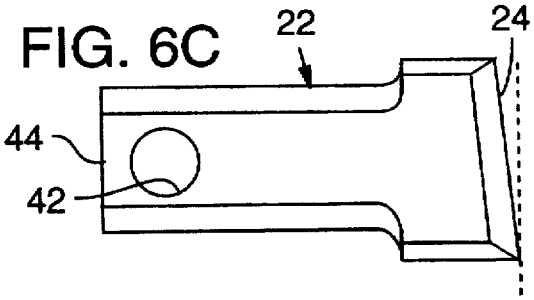
FIG. 6C is a bottom view of the blade.
Figure 7A:
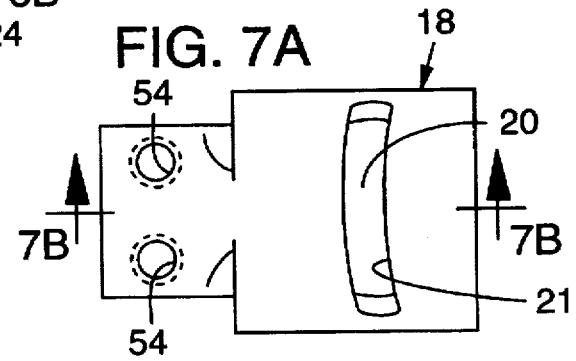
FIG. 7A is a top plan view of the nail holder of FIG. 1.
Figure 7B:
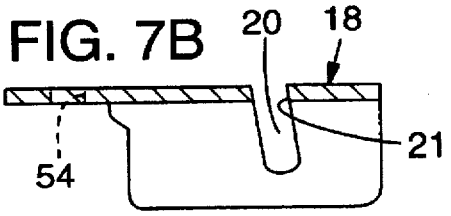
FIG. 7B is a side elevation sectional view of the nail holder taken along line 7B—7B of FIG. 7A.
Figure 9:
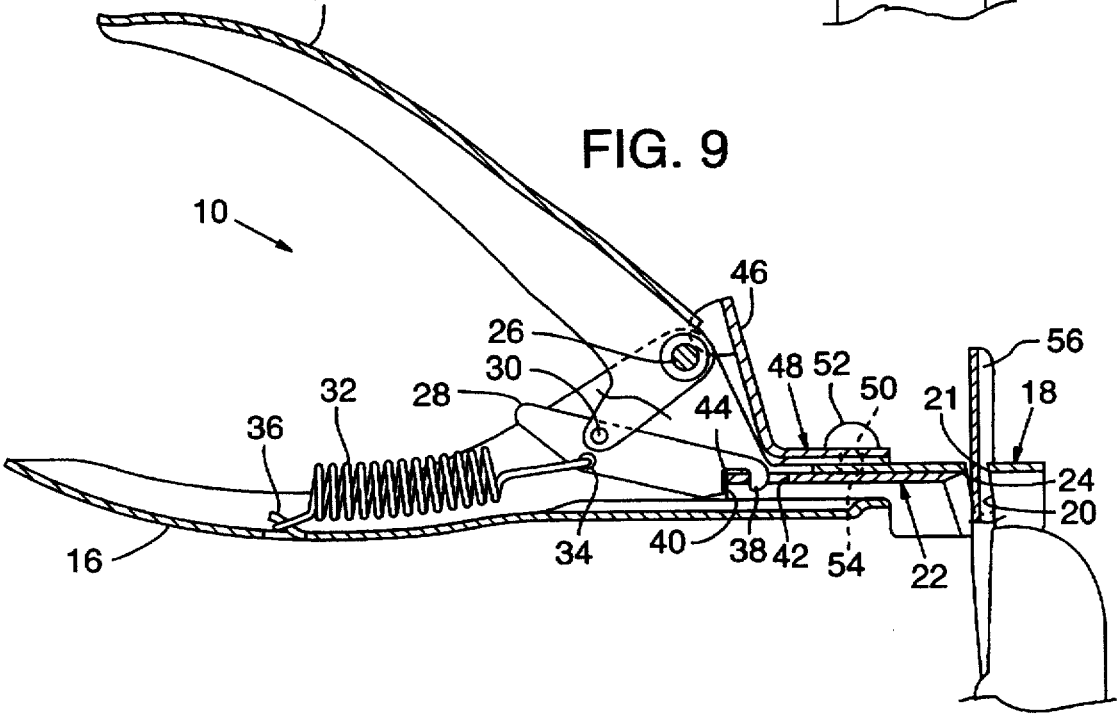
FIG. 9 is a view corresponding to that of FIG. 1, except that a fingernail to be clipped is shown disposed in the ready position.

As shown best in FIG. 6B, the blade edge 24 is beveled to ensure a sharp cutting edge. The bevel angles upwardly so that when a cut is being performed, the blade edge 24 slides against the underside of the nail holder 18 as shown in FIG. 9, and thereby cuts against the cutting edge 21 of the nail holder 18. As will be explained below, the blade edge 24 is designed to slide past the slot 20 and thereby effect the cutting of the fingernail which extends through the slot 20.

Referring now again to the handle 12, the depicted embodiment utilizes a conventional handle, which is configured much like the handle described in my U.S. Pat. No. 4,856,190. As shown best in FIGS. 1 and 9, the pivotable member 14 is mounted to the stationary member 16 at a main pivot point 26. The pivotable member 14 engages a blade engagement link 28 at a link pivot point 30. The blade engagement link 28 is also mounted to a spring 32 at a spring aperture 34. The rear end of the spring is mounted to a spring mount 36.

The forward end of the blade engagement link 28 includes a blade engagement nose 38 and a blade abutment shoulder 40. The blade engagement nose 38 is designed to fit into a hole 42 in the blade, while the blade abutment shoulder 40 is designed to abut the rear end 44 of the blade 22. Because the blade engagement link is directly mounted to the pivotal member of the handle 12, that component or member may be described as terminating in a forwardly extending link which reciprocates forwardly and rearwardly to control the motion of the blade.

Figure 3A:
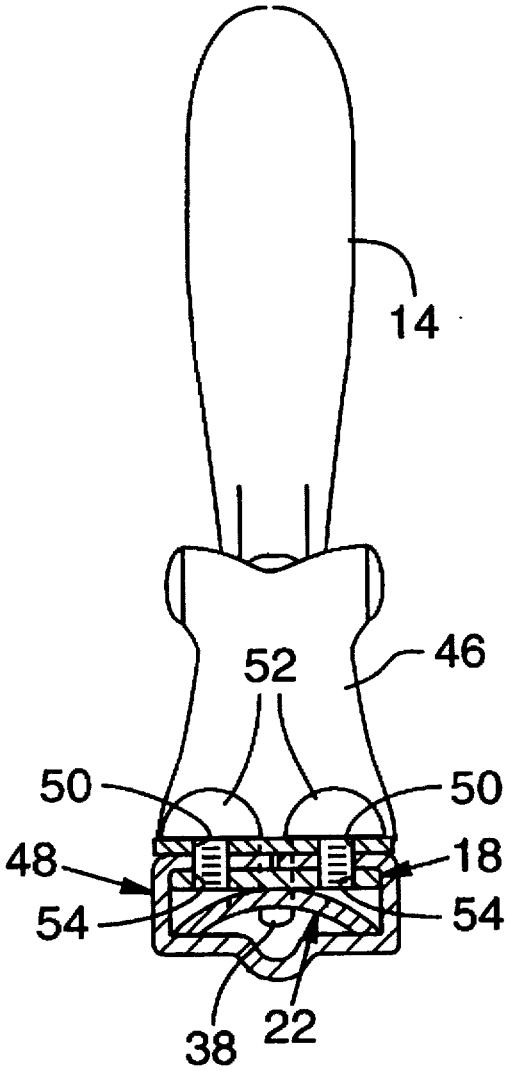
FIG. 3A is a front elevation sectional view taken along line 3A—3A of FIG. 1.
Figure 3B:
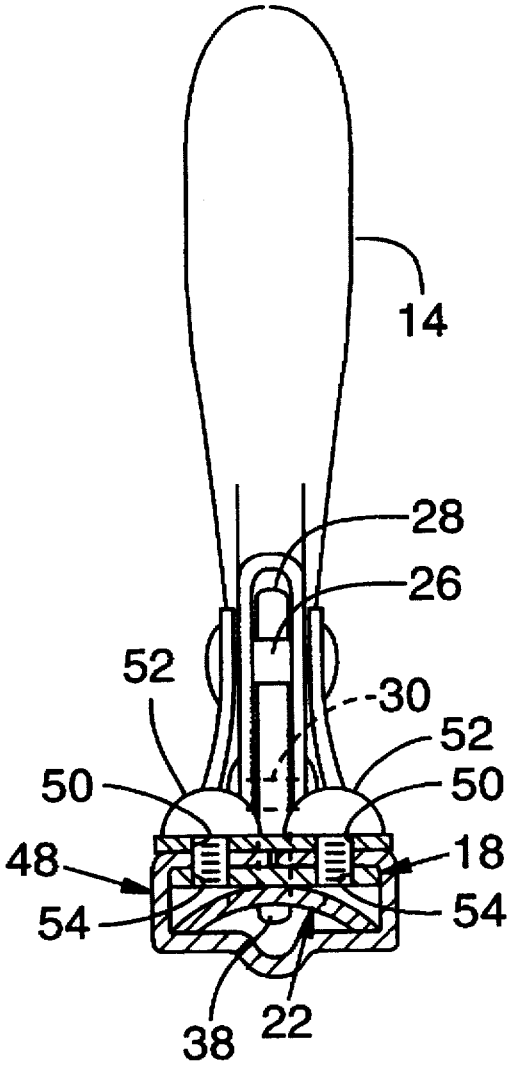
FIG. 3B is a front elevation sectional view corresponding to FIG. 3A, except that the front shield of the handle is deleted for illustrative purposes.

The front of the handle 12 includes a handle shield 46 and a forwardly extending portion 48 which is designed to receive the nail holder 18 and blade 22. The forwardly extending portion 48 includes a pair of holes 50 designed to receive a pair of screws 52. The screws 52 extend downwardly through the holes 50 and engage a pair of holes 54 in the rear portion of the nail holder 18. These holes 54 are threaded so that they receive the screws 52 and are thereby affixed to the upper part of the forwardly extending portion 48. The screws 52 do not extend beyond the nail holder 18, as best shown in FIGS. 3A and B, so that they do not interfere with the sliding movement of the blade 22 disposed thereunder.

Figure 5A:
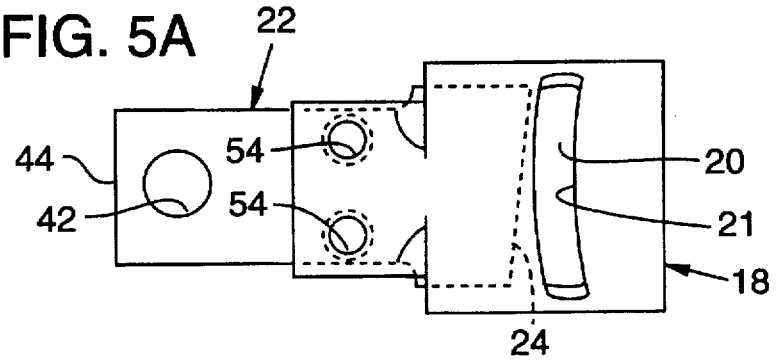
FIG. 5A is a plan view showing the nail holder and blade of FIG. 1, with the blade in its retracted position.
Figure 5B:
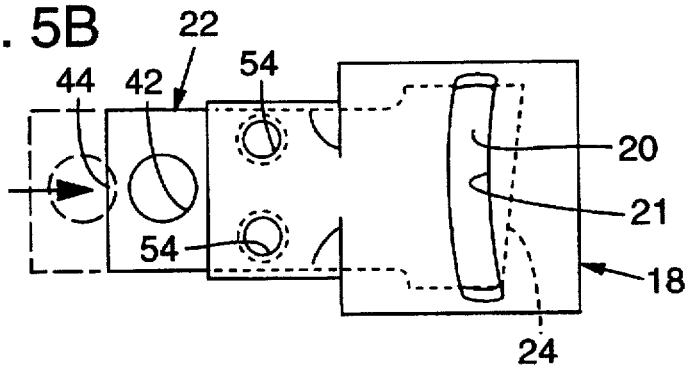
FIG. 5B corresponds to FIG. 5A except that the blade has been moved forwardly, with the cutting edge being shown extending past the nail holder slot.

The sliding action of the blade 22 with respect to the nail holder 18 is best shown in FIGS. 5A and B. FIG. 5A shows the blade 22 in its retracted position wherein the nail can be inserted into the slot 20, while FIG. 5B shows the blade in its forward position having slid across and past the slot. Because of the inclination in the blade edge 24, the cut will be effected gradually and across the nail to provide a clean cut and prevent crushing of the nail by the blade. Because the blade 22 slides under the blade holder 18 and past the slot 20, a cutting action is effected without the blade butting up against a surface of the clipper, unlike the prior art La Casse clipper described above.

USE OF THE PREFERRED EMBODIMENT

Figure 8B:
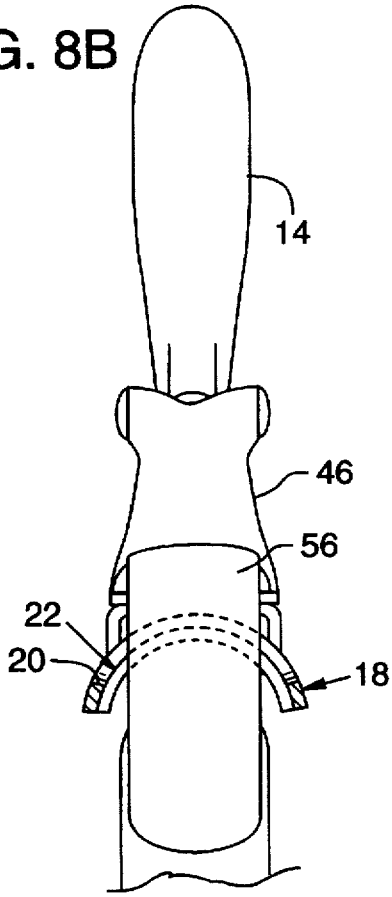

In order to use the clipper 10, the handle 12 is held in one hand, and a fingernail 56 is inserted into the slot 20. Normally, it will be inserted so that the top of the nail faces the handle as shown in FIGS. 8A and 9, although it is possible that the nail might be inverted as shown in FIG. 8B.

To effect the cutting action, the pivotable member 14 is pressed downwardly toward the stationary member 16, thereby causing the blade engagement link 28 to be slid forwardly against the tension of the spring 32. This forward movement of the blade engagement link 28 causes the blade abutment shoulder 40 to push on the rear end 44 of the blade 22. This causes the blade with its blade edge 24 to slide across and past the nail holder slot 20. With the fingernail 56 disposed in the slot as shown in FIG. 9, a cutting action is effected as the blade passes through the slot and the cutting edge 21 thereof. During this entire range of motion the blade 22 is guided by the nail holder 18, even as the blade edge 24 traverses the slot 20. During this traverse, the blade is supported both rearwardly and at the sides of the blade edge.

As shown in FIGS. 8A and B, the curvature of the nail holder 18 and blade 22 is such that a natural curve will be imparted to the nail end. Thus, a single cut can produce a clean, uniform and nicely arcuate end on each of the nails, without the requirement of multiple clipping and extensive filing and buffing. Also, given the fact that the slot 20 extends all the way through the nail holder 18, the clipper can cut nails of unlimited length, whether they be artificial or natural. During the cutting action, the end of the fingernail 56 remains visible to the user, which provides a greater degree of control than some of the prior art designs.

After cutting is effected, the pivotable member 14 is released and the natural tension of the spring 32 will pull the blade engagement link 28 rearwardly, thereby causing the blade engagement nose 38 to pull rearwardly on the blade 22, and returning the blade to the position depicted in FIGS. 1 and 9.

The construction of the clipper 10 is such that both the nail holder 18 and blade 22 can be easily replaced when they become dull. Or, the blade can be removed and replaced after sharpening. This is done by simply pivoting the rear end of the blade engagement link 28 downwardly against the tension of the spring 32, and then sliding the blade out. To re-install the blade, the rear end of the blade engagement link is again pressed downwardly, and the blade is slid back into the clipper.

It may be possible to provide varying degrees of curvature to the nail holder and the blade in the event styles change or if the clipper is used by individuals having different preferences. And in that instance it would be possible to replace the nail holder and the blade with components having differing degrees of curvature than that which is depicted. In the case of such a replacement nail holder and blade (neither of which is depicted), the rearward portions thereof would still conform to the configurations depicted in FIGS. 1–9, so that they could be used with the existing handle 12. In order to remove the nail holder 18, the screws 52 are removed, thereby permitting the nail holder to be slid out of the front portion 48 of the clipper. As described above, the blade 22 is removed by tilting the blade engagement link 28. To install another nail holder, it is merely inserted into the front of the clipper and the screws 52 are re-installed. Then, the blade 22 is re-inserted as described above It is possible that variations can be made in the embodiment described and depicted above, and the following claims are intended to encompass such variations and modifications.

It is claimed and desired to secure by Letters Patent:

1. A fingernail clipper for trimming a fingernail to an arcuate shape that curves downwardly toward each side of the fingernail, comprising:

a nail holder having an aperture defined therein for receiving the fingernail to be trimmed, with the nail holder and the aperture being curved downwardly to produce the arcuate shape;

a movable blade having a cutting edge disposed slidably against the nail holder, the cutting edge being movable across and past the aperture when relative movement is effected between the nail holder and the blade;

the nail holder further serving to guide the blade across and past the aperture;

the blade being curved downwardly to produce the arcuate shape;

a handle having first and second components which are movable with respect to each other, the first component being mounted to the nail holder, and the second component being mounted to the blade so that when relative movement is effected between the first and second components, the blade slides with respect to the nail holder, thereby moving the cutting edge across and past the aperture while being guided by the nail holder to clip a fingernail disposed within the aperture.

2. The clipper of claim 1 wherein the blade has an upper surface and a lower surface, with the upper surface facing the nail holder, and in order to clip a fingernail the finger is positioned adjacent the lower surface of the blade.

3. The clipper of claim 1, further comprising a slot which is defined at least in part by a cutting, and wherein the slot extends entirely through the nail holder.

4. The clipper of claim 3 wherein the fingernail is visible through the slot while the nail is being clipped.

5. The clipper of claim 1 wherein the nail holder includes a proximal end mounted to one of the handle components and a distal end defining a free end extending from the clipper, and wherein the distal end of the nail holder is curved downwardly toward each side of the fingernail being cut.

6. The clipper of claim 1 wherein the first and second components are pivotable with respect to each other.

7. The clipper of claim 1 wherein the nail holder and the blade are removably mounted to the handle and are replaceable components.

8. The clipper of claim 1 wherein the second component of the handle terminates in a forwardly extending link which reciprocates forwardly and rearwardly to control the forward and rearward motion of the blade.

9. A fingernail clipper, comprising:

a clipper handle including a first component and a second component which are movable with respect to each other;

a nail holder extending from the clipper handle, the nail holder having a curved cross section and defining a slot therein for receiving and holding a nail to be clipped; and a blade being slidably mounted with respect to the nail holder and having a cross section corresponding to the curved cross section of the nail holder, the blade having a blade edge which is moveable past the slot for clipping the nail while the nail is held in the slot;

the nail holder and the blade each being mounted to one of the first and second handle components so that when relative movement is effected between the handle components, the nail holder and the blade move with respect to each other to effect a cutting action by the blade edge as the nail is held in the slot.

10. The clipper of claim 9 wherein the first component is stationary and the nail holder is mounted thereto and extends therefrom, and the second component is pivotable and the blade is mounted thereto and extends therefrom, the second component terminating in a forwardly extending link which reciprocates forwardly and rearwardly to control forward and rearward motion of the blade.

11. The clipper of claim 9 wherein the nail holder includes a proximal end which faces the clipper handle, and a distal end which extends away from the clipper handle, and wherein the distal end of the nail holder terminates in the curved cross section.

12. The clipper of claim 9 wherein the slot extends entirely through the nail holder so that the nail to be clipped can extend entirely through the nail holder slot.

13. A fingernail clipper comprising:

a nail holder with a curved cross section and having a slot for receiving the nail to be clipped, the nail holder having an underside; and a blade disposed slidably against the underside of the nail holder and having a cross section complementing the nail holder and being reciprocable with respect to the nail holder, wherein the nail holder guides the travel of the blade through its entire stroke, so that the nail is clipped between the nail holder and the blade by extending the nail into the slot from the underside thereof, and then effecting relative movement between the nail holder and the blade.

14. The clipper of claim 13 wherein the slot is defined at least in part by a cutting edge, and wherein the blade is reciprocable past the cutting edge, so that to cut the nail the blade is guided by the nail holder past the slot and the cutting edge.

15. The clipper of claim 13 wherein the slot extends entirely through the nail holder.

16. The clipper of claim 13 wherein the blade remains in substantial contact with the nail holder throughout its stroke.

17. The clipper of any of claim 9, 13 or 1 wherein the blade is replaceable.

* * * * *